United States Patent [19]

Berman

[11] 4,356,943

[45] Nov. 2, 1982

[54] ACCESSORY FOR TROUSERS AND THE LIKE

[76] Inventor: Charles Berman, 6025 Shore Blvd., Gulfport, Fla. 33707

[21] Appl. No.: 325,022

[22] Filed: Nov. 25, 1981

Related U.S. Application Data

[63] Continuation-in-part of Ser. No. 164,833, Jun. 30, 1980, Pat. No. 4,303,187.

[51] Int. Cl.[3] ..... A45C 11/00

[52] U.S. Cl. ..... 224/222; 224/240; 224/253

[58] Field of Search ..... 224/222, 226, 240, 253, 224/904

[56] References Cited

U.S. PATENT DOCUMENTS

| | | | |
|---|---|---|---|
| 315,303 | 4/1885 | Lambert | 224/240 |
| 2,983,412 | 5/1961 | Ferguson | 224/253 X |
| 3,949,916 | 4/1976 | Yount | 224/240 |
| 4,303,187 | 12/1981 | Berman | 224/222 |

*Primary Examiner*—Steven M. Pollard
*Attorney, Agent, or Firm*—Philip D. Amins

[57] ABSTRACT

A clothing accessory is provided which includes a base panel, the upper portion of which is bifurcated to form a pair of belt loop portions through which a wearer passes their belt thereby securing the accessory to the trousers in juxtaposition to one of the belt loops of the trousers. The lower portion of the base panel includes a pocket or similar receptacle for storage of personal objects. The pocket or receptacle may be formed integrally with the base panel or secured thereto.

12 Claims, 10 Drawing Figures

FIG. 1
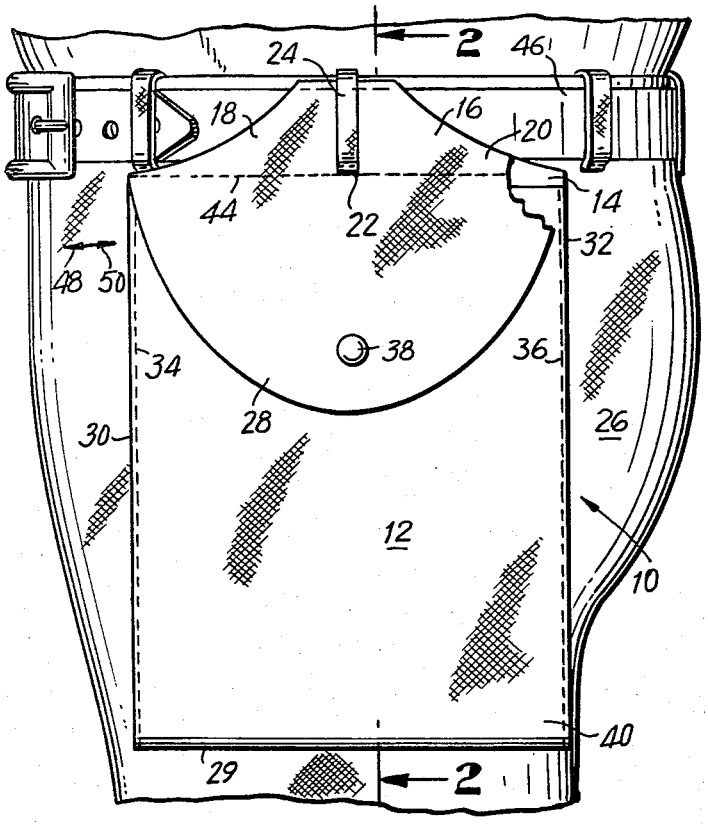
FIG. 2
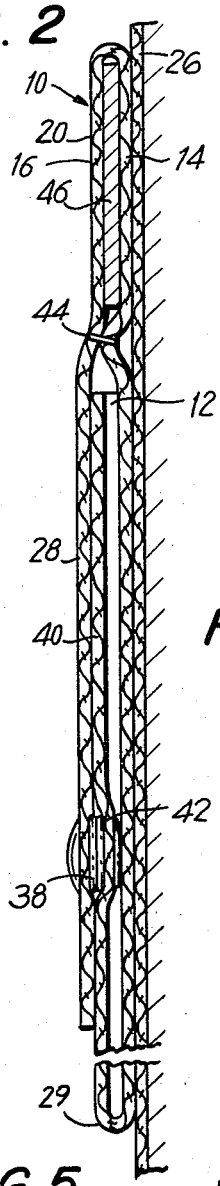
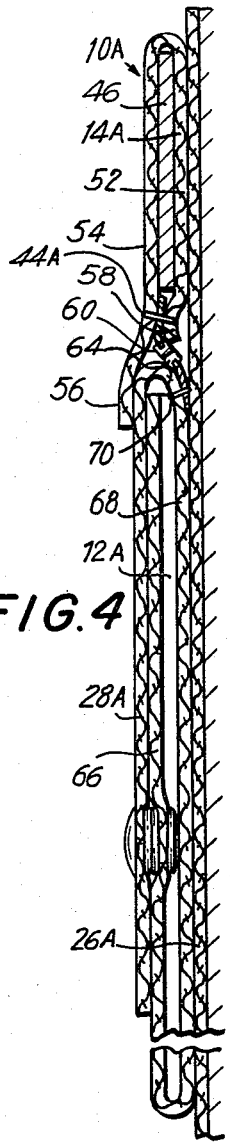
FIG. 4
FIG. 3
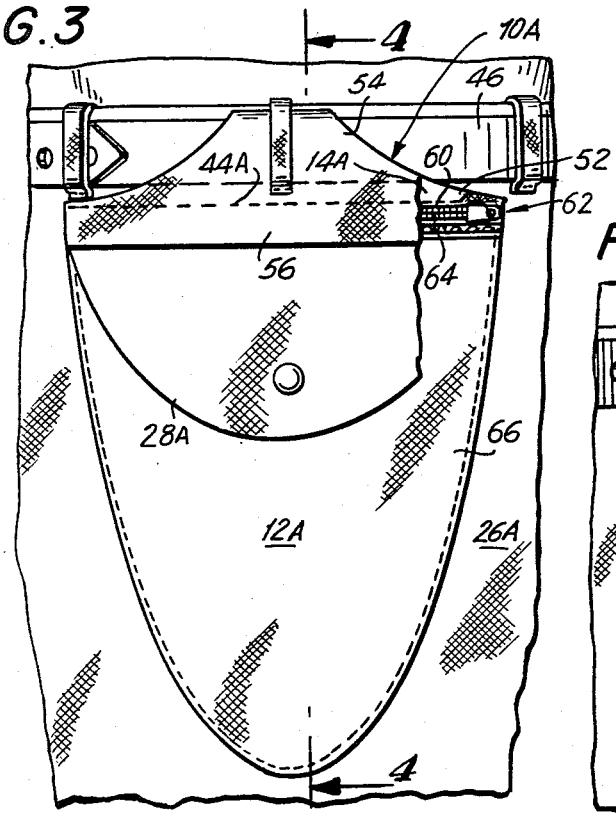
FIG. 5
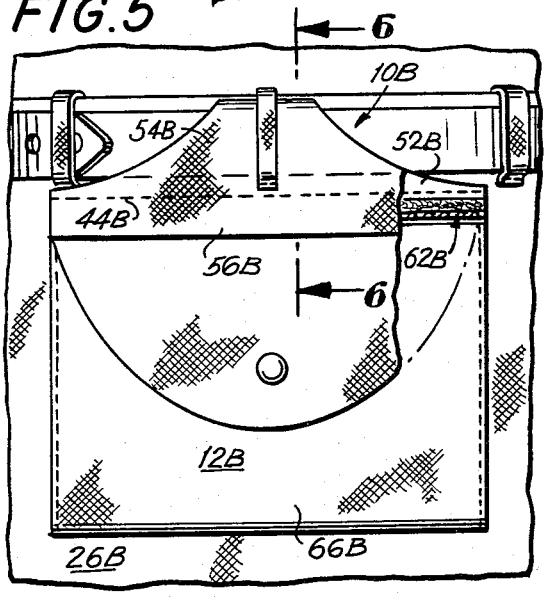

FIG. 6
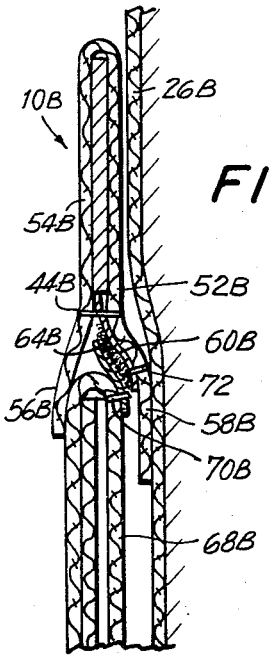
FIG. 7
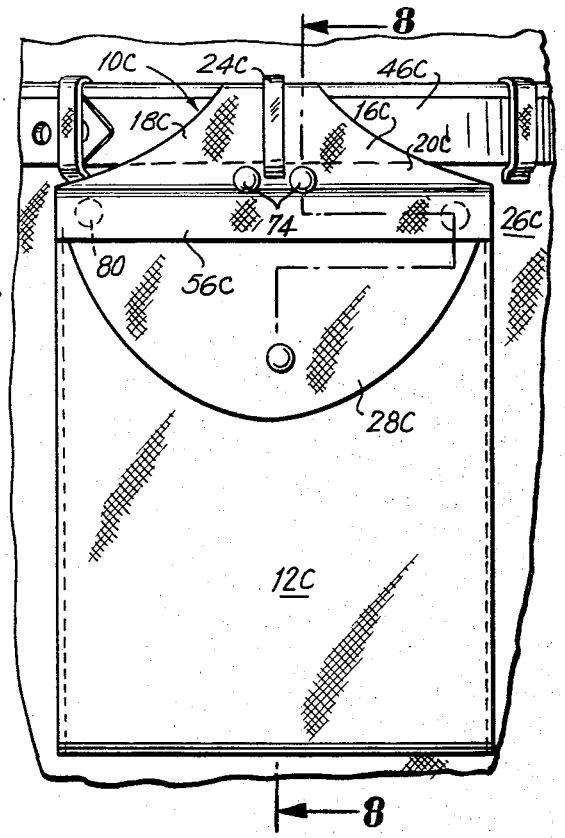
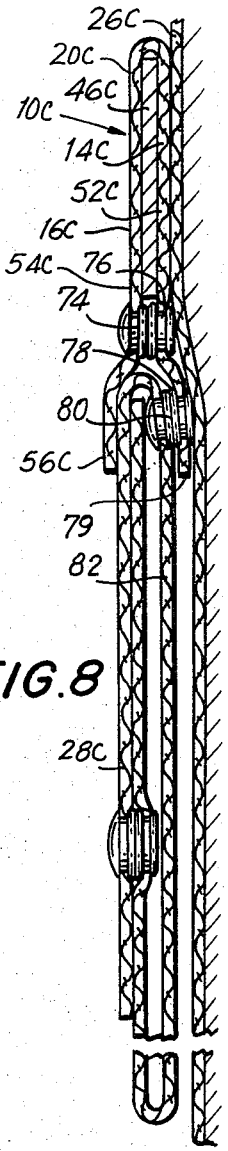
FIG. 8
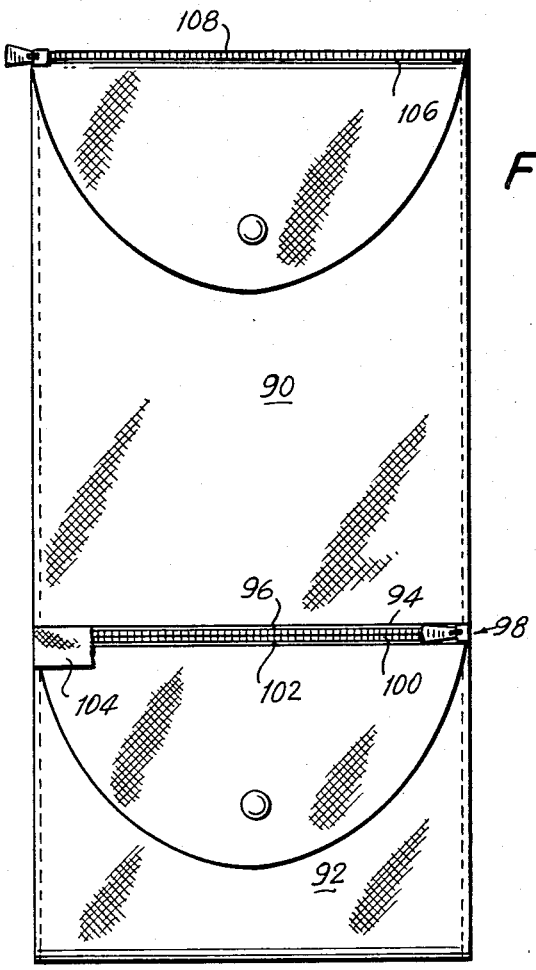
FIG. 9
FIG. 10
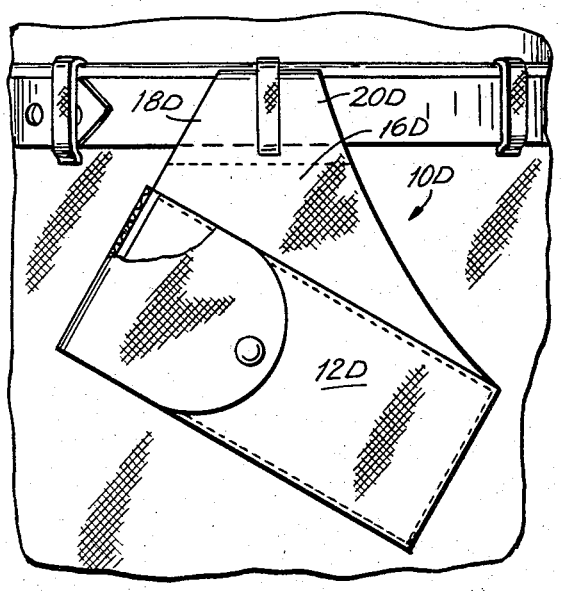

ACCESSORY FOR TROUSERS AND THE LIKE

The present application is a continuation-in-part of my earlier filed application entitled MULTIPLE POCKET CLOTHING ACCESSORY, Ser. No. 06/164,833, filed June 30, 1980; now U.S. Pat. No. 4,303,187.

BACKGROUND OF THE INVENTION

Recent trends in clothing fashions for both adults and children have led to a widespread and increasingly high rate of usage of trousers of the jeans type. These trousers are cut so as to generally conform closely to the contours of the body and usually include several pockets of the patch type. This type of pocket is constructed of a single panel of fabric which has three adjacent marginal edges sewn to the body of the garment leaving the fourth edge open for insertion of objects into the pocket. The narrow body conforming cut of jeans-type trousers makes such pockets awkward to use because it is relatively difficult to place a hand into the pocket in order to insert or remove objects. Even when slash-type pockets are provided, which have an interior fabric envelope, which is accessible through a slash in the fabric of the garment, the narrow cut of the jeans-type of trouser renders these pockets impractical or awkward, because objects inserted in such pockets cause objectionable bulges which detract from the trim line of the garment and are, therefore, considered objectionable. In addition, because of the relatively close fit of the jeans-type of trouser, when an object is inserted into a pocket, either of the slash-type or the patch-type, and the wearer engages in an active sport such as bicycling or an activity such as dancing, the object tends to work its way out of the pocket thereby becoming lost.

The problems described result in an anomalous situation in which the pockets provided on the jeans-type of trousers, even though they represent a significant portion of the manufacturing cost of this garment, do not contribute to the utility of the garment and are often considered to be non-functional by the wearer.

OBJECTS OF THE INVENTION

It is a primary object of the present invention to provide a clothing accessory for use with trousers of the jeans type which provides the wearer with a pocket or other type receptacle for the comfortable and convenient storage of personal objects.

It is another object of the present invention to provide a clothing accessory which can be secured to a trouser belt.

It is yet another object of the present invention to provide a clothing accessory which can be selectively worn with trousers.

It is still another object of the present invention to provide a clothing accessory which includes a fastener for enabling the selective securement of pockets or other type receptacles thereto.

It is a further object of the present invention to provide a clothing accessory having detachable fastening means to permit the selective securement of one or a plurality of pockets or other type receptacles therewith.

It is still a further object of the present invention to provide a clothing accessory which may be fabricated in a wide variety of fabric materials thereby providing a contrast or a match with the fabric of the garment on which the accessory is worn.

It is yet a further object of the present invention to provide a clothing accessory whose configuration can be selectively varied and which may be used both by male and female wearers.

It is yet another object of the present invention to provide a clothing accessory which comprises a relatively small number of component parts which are relatively economical of manufacture.

SUMMARY OF THE INVENTION

In accordance with one embodiment of the present invention, a clothing accessory is provided which is constructed of fabric or similar material, and which includes a base panel, on the upper portion of which there are formed belt loop portions through which a wearer passes a belt thereby attaching the accessory to their trousers. A singular or plurality of pockets are secured to the base panel either by integral formation or by fastening to the base panel. The lower portion of the base panel includes the pocket integrally formed therewith or a fastening means which is capable of securement with the upper portion of a pocket member.

In an alternative embodiment of the invention, the belt loop portions are adjustable to enable the selective vertical placement thereof and enables the placement of the clothing upon the belt of the wearer after the same has been passed through the belt loops of the trousers.

BRIEF DESCRIPTION OF THE DRAWINGS

The foregoing and other objects, features and advantages of the present invention will become readily apparent to those skilled in the art from the detailed description hereinafter, considered in conjunction with the accompanying drawings, wherein:

FIG. 1 is a front elevation view of a first embodiment of the clothing accessory constructed in accordance with the present invention with the accessory shown in use by a wearer;

FIG. 2 is a longitudinal sectional view taken along the line 2—2 of FIG. 1;

FIG. 3 is a front elevational view of a second embodiment of the invention with the accessory shown in use by a wearer;

FIG. 4 is a longitudinal sectional view taken on the line 4—4 of FIG. 3;

FIG. 5 is a front elevational view depicting a third embodiment of the present invention with the pocket member being broken away to illustrate the securement of the pocket member to the accessory;

FIG. 6 is a longitudinal sectional view taken on the line 6—6 of FIG. 5;

FIG. 7 is a front elevational view depicting another embodiment of the invention wherein the clothing accessory is vertically adjustable with respect to the belt of a wearer to permit selective positioning of said accessory;

FIG. 8 is a longitudinal sectional view taken on the line 8—8 of FIG. 7;

FIG. 9 is a front elevational view depicting a plurality of pocket members adapted to be secured to the clothing accessory of the present invention depicted generally in FIGS. 3 and 7; and FIG. 10 is a front elevational view of an alternative type of receptable clothing accessory of the present invention.

DETAILED DESCRIPTION OF THE PREFERRED EMBODIMENTS

Referring now to the drawings, and more particularly to FIGS. 1 and 2, there is shown one embodiment of the present invention which comprises a clothing accessory generally denoted by the reference numeral 10, wherein the pocket 12 is formed integrally therewith.

The accessory 10 comprises a base panel 14 having an upper portion 16 which includes a pair of spaced apart belt loop portions 18 and 20 formed by folding the upper portion, as best seen in FIG. 2. The belt loop portions 18 and 20 are separated by a slot 22 whose dimensions are substantially the same as that of the belt loop 24 of the wearer's trousers 26. The upper portion 16 also includes a depending lower arcuate portion 28. The lower portion 29 of the base panel 14 is folded over upon itself and sewn along the marginal edges 30, 32, as indicated by the broken lines 34, 36 in FIG. 1, to thereby form the pocket 12 with the portion 28 serving as a closure flap for said pocket. The closure flap 28 is secured to the pocket 12 by means of a pair of male and female snap fasteners, with the female fastener of the pair which is secured to flap 28 being designated by the reference numeral 38 and with the male fastener of the pair which is secured to the front panel 40 of the pocket being designated by the reference numeral 42.

The upper portion 16 is sewn by stitching 44 (broken lines FIG. 1) to form the belt loop portions 18 and 20 and the closure flap 28. Thus, the clothing accessory 10 includes the pocket 12 as an integral member. In the preferred fabrication of the accessory, the device is first sewn to provide the stitching 44 and thereafter the slot 22 is cut in the upper portion 16 to form the bifurcated belt loop portions 18 and 20. Alternatively, the upper portion may initially have a bifurcated configuration and be folded over to form slot 22, whereafter the upper portion 16 is sewn to provide stitching 44 and the belt loop portions 18 and 20.

As is shown in FIG. 1, the belt loop portions 18 and 20, formed by the bifurcation of upper portion 16, are spaced apart and positionally disposed on opposite sides of the belt loop 24 of the wearer's trousers 26, after the belt 46 has been passed therethrough. Thus, the device or accessory 10 is prevented from sliding along the belt 46 in the directions of the arrows 48, 50. The belt 46 which passes through the belt loop portions 18 and 20 (FIG. 2), supports the weight of the device 10.

A second embodiment of the clothing accessory of the present invention is depicted in FIGS. 3 and 4, wherein similar parts are denoted by similar reference numerals. In this embodiment the clothing accessory 10A is intended to have any one of a plurality of receptacles for the storage of personal items, secured thereto. Thus, it will be readily apparent that the particular pocket 12A shown and described herein is solely for illustrative purposes. The accessory 10A comprises a base panel 14A which includes a rear panel portion 52 and a front panel portion 54 which terminates in a depending flap 56. The lower end 58 of the rear panel portion 52 has the upper half 60 of a zipper assembly 62 secured thereto by means of the stitching 44A.

A pocket assembly 12A having a substantially oval configuration is detachably securable to the accessory 10A by means of a lower half 64 of the zipper assembly 62. The pocket 12A includes a closure flap 28A, a front panel 66 and a rear panel 68. The lower zipper half 64 is sewn to the upper end portion of the rear panel 68 by stitching 70.

When it is desired to use the pocket receptacle 12A with the clothing accessory member 10A, the lower zipper half 64 is matingly engaged with upper zipper half 60. The flap 56 covers the zipper assembly 62 so that it appears that the accessory 10A and pocket 12A are an integral assembly. Further, if the fabric of which accessory 10A, pocket 12A and trousers 26A are formed, are all alike (such as denim), then it will appear that the accessory 10A and pocket 12A are an integral part of the trousers 26A.

It is herein to be noted that while I have shown and illustrated a pocket as being detachably securable to the accessory, it is within the purview and contemplation to provide any suitable receptacle for the storage of personal items; e.g., cigarette case, eyeglass case or comb case.

A third embodiment of the present invention is depicted in FIGS. 5 and 6, wherein similar parts are denoted by similar reference numerals. The accessory 10B includes the front panel portion 54B having a depending flap 56B which covers the detachable fastening assembly 62B. The fastening assembly 62B comprises a cooperating hook and eye rapid attachment, quick release fastener well known to those skilled in the art and sold, for example, under the trademark VELCRO. The pocket assembly 12B includes the front panel 66B and the rear panel 68B to which is secured one part 64B of the fastening assembly 62B by means of stitching 70B. A mating strip 60B for the element 64B is secured to the lower end 58B of the rear panel portion 52B by means of stitching 44B and 72, as best seen in FIG. 6.

It is herein to be noted that the fastening assembly 62B is hidden from view by means of the cover flap 56B, whereby the appearance is that the pocket 12B is an integral portion of the trousers 26B. The fastening assembly 62B provides a secure connection of the pocket 12B to the accessory 10B, when desired, and a means of rapid detachment when the pocket is not desired to be worn with the trousers. Of course, any other type of receptacle may also be employed by the use of a fastening assembly structure 62B.

A fourth embodiment of the present invention is depicted in FIGS. 7 and 8, where similar parts are again denoted by similar reference numerals. The upper portion 16C of the base panel 14c includes a pair of spaced apart belt loop portions 18C and 20C which are formed by folding the upper portion 16C of base panel 14C, as shown in FIG. 8. A pair of male and female snap fasteners are used to close the belt loop portions 18C and 20C, with the female fastener of the pair designated by the reference numeral 74 and the male fastener of the pair being designated by the reference numeral 76.

It is herein to be noted that the accessory 10C may be fabricated of a double layer of fabric whereby the female fasteners would not be visible; and additional female fasteners may be provided so as to lengthen or shorten the belt loop portions, as is disclosed in my earlier application, now U.S. Pat. No. 4,303,187.

The belt loop portions 18C and 20C are spaced apart and fit on either side of the belt loop 24C of the wearer's trousers 26C thereby preventing the device 10C from sliding along the belt 46C, as described previously herein in conjunction with FIG. 1. The belt 46C passes through the belt loop portions 18C and 20C as shown in FIG. 8, and supports the weight of the device 10C.

A pocket assembly 12C is detachably securable to the accessory 10C by means of a pair of male and female snap fasteners comprising female fasteners 78 secured to the lower end portion 79 of the rear panel portion 52C, and male fasteners 80 secured to the rear wall 82 of the pocket assembly 12C. The front panel portion 54C of base panel 14C terminates in the depending flap 56C which overlaps the closure flap 28C.

Although the various embodiments of the present invention have been described as being provided with a single receptacle, it is within the purview and contemplation of the present invention to provide multiple receptacles which are detachably securable with respect to each other, as well as to the clothing accessory. FIG. 9 depicts such an arrangement wherein the receptacles are depicted as pockets. The pockets 90 and 92 are detachably securable with respect to one another as illustrated. In particular, the lower edge portion 94 of the pocket 90 is provided with one half 96 of a zipper assembly 98; the other half 100 of the zipper assembly 98 being secured to the upper edge portion 102 of the pocket 92. When the zipper halves 96 and 100 are matingly engaged (as shown in FIG. 9), they are not visible due to the fact that the zipper assembly 98 is covered by the depending cover flap 104 of the lower edge portion 94 of the pocket 90.

The upper edge portion 106 of pocket 90 is provided with another zipper half 108 which is adapted for detachable securement to a clothing accessory (not shown) in the manner described previously herein in conjunction with the embodiment of FIG. 3. Similarly, if the detachable fastener provided on pocket 90 is other than a zipper half, the same may be utilized in the manner taught by reference to the embodiments disclosed in FIGS. 5 and 7.

FIG. 10 depicts a receptacle in the form of an eyeglass case denoted generally by the reference numeral 12D. The case 12D is secured to the upper portion 16D of an accessory 10D having belt loop portions 18D and 20D, with the case 12D being formed as an integral part of the accessory 10D.

While I have shown and described the various preferred embodiments of my invention, it will be apparent to those skilled in the art that there are many changes, improvements and modifications which may be made therein without departing from the spirit and scope of the invention as defined in the appended claims.

In the claims:

1. A clothing accessory comprising
a base panel including
an upper portion, and
a lower portion,
said upper portion being bifurcated to form a pair of spaced apart belt loop portions,
said belt loop portions being disposed on said upper portion of said base panel for the purpose of securing said upper portion to the belt of a user, and
said belt loop portions being spaced from one another a distance substantially equal to the width of a belt loop of a pair of trousers worn by said user so as to enable said belt loop portions to be disposed in juxtaposition with respect to said belt loop.

2. A clothing accessory in accordance with claim 1, wherein
said lower portion includes means for permitting the detachable securement of a receptacle member thereto.

3. A clothing accessory in accordance with claim 1, wherein
said lower portion comprises a receptacle member integrally formed with said upper portion.

4. A clothing accessory in accordance with claim 3, wherein
said receptacle member comprises a pocket assembly.

5. A clothing accessory in accordance with claim 1, including
a receptacle member,
said lower portion of said base panel including a first mating portion thereon,
said receptacle member having an upper edge portion including a second mating portion thereon, and
said second mating portion being capable of mating engagement with said first mating portion to permit detachable securement of said receptacle member with said lower portion of said base panel.

6. A clothing accessory in accordance with claim 5, wherein
said receptacle member comprises
a first receptacle element, and
a second receptacle element,
means for securing the upper edge of said second receptacle element to the lower edge of said first receptacle element, and
said second mating portion being disposed on the upper edge portion of said first receptacle element.

7. A clothing accessory in accordance with claim 6, wherein
said means for securing the respective edges of said first and second receptacle elements provides for the detachable securement of said receptacle elements with respect to one another.

8. A clothing accessory in accordance with claim 6, wherein
at least one of said first and second receptacle elements is a pocket assembly.

9. A clothing accessory in accordance with claim 5, wherein
said first and second mating portions comprise respective halves of a detachable zipper assembly.

10. A clothing accessory in accordance with claim 5, wherein
said first and second mating portions comprise respective segments of an hook and eye detachable fastener.

11. A clothing accessory in accordance with claim 5, wherein
said first mating portion comprises at least two first snap fastener elements, and
said second mating portion comprises at least two second snap fastener elements.

12. A clothing accessory in accordance with claim 5, wherein
said lower portion of said base panel includes a depending cover member, and
said cover member being capable of overlapping the mated first and second mating portions to hide the same from view.

* * * * *